US005945648A

United States Patent [19]

M'Sadoques

[11] Patent Number: 5,945,648

[45] Date of Patent: Aug. 31, 1999

[54] PUSH-BUTTON INTERLOCK MECHANISM FOR AN INDUSTRIAL-RATED CIRCUIT BREAKER

[75] Inventor: André J. M'Sadoques, Southington, Conn.

[73] Assignee: General Electric Company, Schenectady, N.Y.

[21] Appl. No.: 08/878,594

[22] Filed: Jun. 19, 1997

[51] Int. Cl.[6] ..... H01H 9/28

[52] U.S. Cl. ..... 200/43.14; 200/50.11

[58] Field of Search ..... 200/50.11, 50.19, 200/43.14

[56] References Cited

U.S. PATENT DOCUMENTS 5,477,016 12/1995 Baginski et al. ..... 200/43.14 X

*Primary Examiner*—Renee S. Luebke

*Attorney, Agent, or Firm*—Cantor Colburn LLP; Carl B. Horton

[57] ABSTRACT

A circuit breaker interlock mechanism interacts between the circuit breaker operating handle and circuit breaker closing button to prevent the closing button from operating to close the circuit breaker contacts when the circuit breaker is padlocked in the OFF condition. A slide plate mounted on the interior of the circuit breaker cover engages a blocking plate attached to the circuit breaker closing rod. The interlock serves further to prevent the circuit breaker from being padlocked on the ON condition in the event the contacts become welded together in the closed position.

14 Claims, 6 Drawing Sheets

PUSH-BUTTON INTERLOCK MECHANISM FOR AN INDUSTRIAL-RATED CIRCUIT BREAKER

BACKGROUND OF THE INVENTION

Air circuit breakers as described within U.S. Pat. Nos. 3,095,489 entitled "Manual Charging Means for Stored Energy Closing Mechanisms of Electric Circuit Breakers" and 3,084,238 entitled "Ratchet Mechanism for Charging a Closing Spring in an Electric Circuit Breaker" include operating mechanisms that are mainly exposed to the environment. Since the air circuit breakers are rated to carry several thousand amperes of current continuously, the exposure to convection cooling air assists in keeping the operating components within reasonable temperature limits.

Such air circuit breakers are usually provided with a motor operator such as described in U.S. Pat. No. 4,167,988 entitled "Ratcheting Mechanism for Circuit Breaker Motor Operator" or a manual handle as described in U.S. Pat. No. 3,729,065 entitled "Means for Charging A Stored Energy Circuit Breaker Closing Device" for charging the powerful closing springs contained within the air circuit breaker operating mechanism.

When the circuit breaker closing springs are brought to their fully-charged conditions, it is important that the springs do not become inadvertently discharged while an operator has hold of the charging handle in order to avoid damage to the ratchet mechanism and the associated air circuit breaker contacts. An early arrangement of a latching means to prevent rotation of a closing springs charging handle is found in U.S. Pat. No. 4,475,021 entitled "Air Circuit Breaker".

When the circuit breaker closing springs are completely charged, the holding pawl is removed from the charging gear to allow the charging shaft to rotate in the reverse direction when the circuit breaker closing button is activated, as described in U.S. patent application Ser. No. 08/863,649 entitled "Ratcheting Mechanism for an Industrial-Related Circuit Breaker".

The above-noted U.S. patents and U.S. patent application include means for opening and closing the circuit breaker contacts by direct access to the circuit breaker as well as from a remote location. To prevent closing the circuit breaker contacts when the associated electric equipment is undergoing replacement or repair, interlocks are required. U.S. Pat. No. 5,504,285 entitled "Circuit Breaker Indicating Flag Interlock Arrangement Operating Springs" and U.S. Pat. No. 5,478,979 entitled "Circuit Breaker Closing and Opening Interlock Assembly" provide interlock arrangements acting between the circuit breaker ON and OFF buttons to prevent inadvertent turn on of so called "insulated case" circuit breakers wherein the circuit breaker operating components are completely contained within a common enclosure.

It is known that circuit breaker contacts can become welded closed upon repeated intense overcurrent occurrence, especially when the circuit breaker is used within circuits that occasionally carry circuit current in excess of the circuit breaker ratings.

When multipole circuit breakers such as described in the aforementioned U.S. Pat. Nos. 3,084,238 and 3,905,489 incur one set of welded contacts while the remainder of the contacts within the separate poles remain operational, it is helpful to identify which of the contacts have become welded.

SUMMARY OF THE INVENTION

A circuit breaker interlock mechanism interacts between the circuit breaker operating handle and circuit breaker closing button to prevent the closing button from operating to close the circuit breaker contacts when the circuit breaker is padlocked in the OFF condition. A slide plate mounted on the interior of the circuit breaker cover engages a blocking plate attached to the circuit breaker closing rod. Unlocking the circuit breaker allows the blocking plate to move past the slide plate to move the closing rod into contact with the operating mechanism closing bar to release the closing springs and close the circuit breaker contacts. The interlock serves further to prevent the circuit breaker from being padlocked in the ON condition in the event the contacts become welded together in the closed position.

DESCRIPTION OF THE PREFERRED EMBODIMENT

Figure 1:
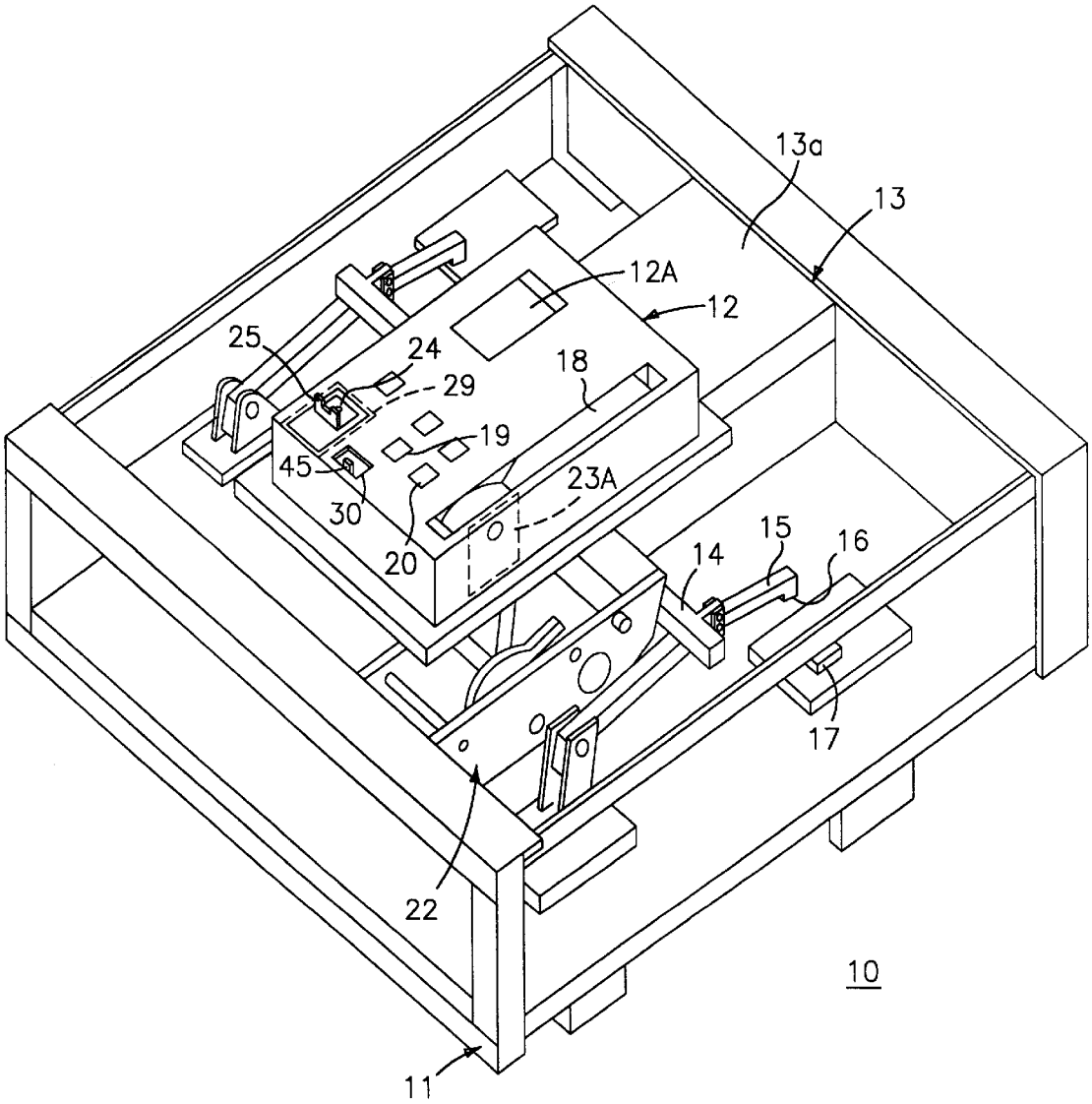
FIG. 1 is top perspective view of an air circuit breaker containing the circuit breaker closing button interlock mechanism according to the invention.

The air circuit breaker 10 of FIG. 1 is similar to that described within the aforementioned U.S. Pat. No. 3,095,489 and includes a metal frame 11 which supports circuit breaker cover 12, the trip unit programmer 12A and the operating mechanism enclosure 13 having an access cover 13A. The trip unit programmer is similar to that described in U.S. Pat. No. 4,672,501 entitled "Circuit Breaker and Protective Relay Unit". The cover further includes a trip or OFF button 19 for releasing the circuit breaker operating mechanism contained within the enclosure 13 for separating the circuit breaker contacts 16, 17 to their open condition and a closing button 20 for moving the contacts to their closed position. The circuit breaker contact arms 15 within each pole of a three pole circuit arrangement are interconnected by means of the operating mechanism crossbar 14 to insure that all contacts within the separate poles both open and close in unison. The ratcheting mechanism 22 improves over the earlier mechanism described in the aforementioned U.S. Pat. No. 3,729,065 by allowing the operating mechanism closing springs described therein to be charged remotely by means of a motor operator. The operating handle 18 interacts with the ratcheting mechanism 22 by means of a pair of plate connectors, one of which is indicated at 23A. In accordance with the teachings of the invention, a padlock slide 24 is arranged over an opening 29 within the cover 12 and includes an aperture 25 for receiving a locking hasp to hold the slide in a locked position. A lock slide 30, having an access handle grip 45, is arranged under the OFF button 19 for interacting with the padlock slide 24 to prevent release of the lock slide until and unless the circuit breaker contacts are separated.

Figure 2:
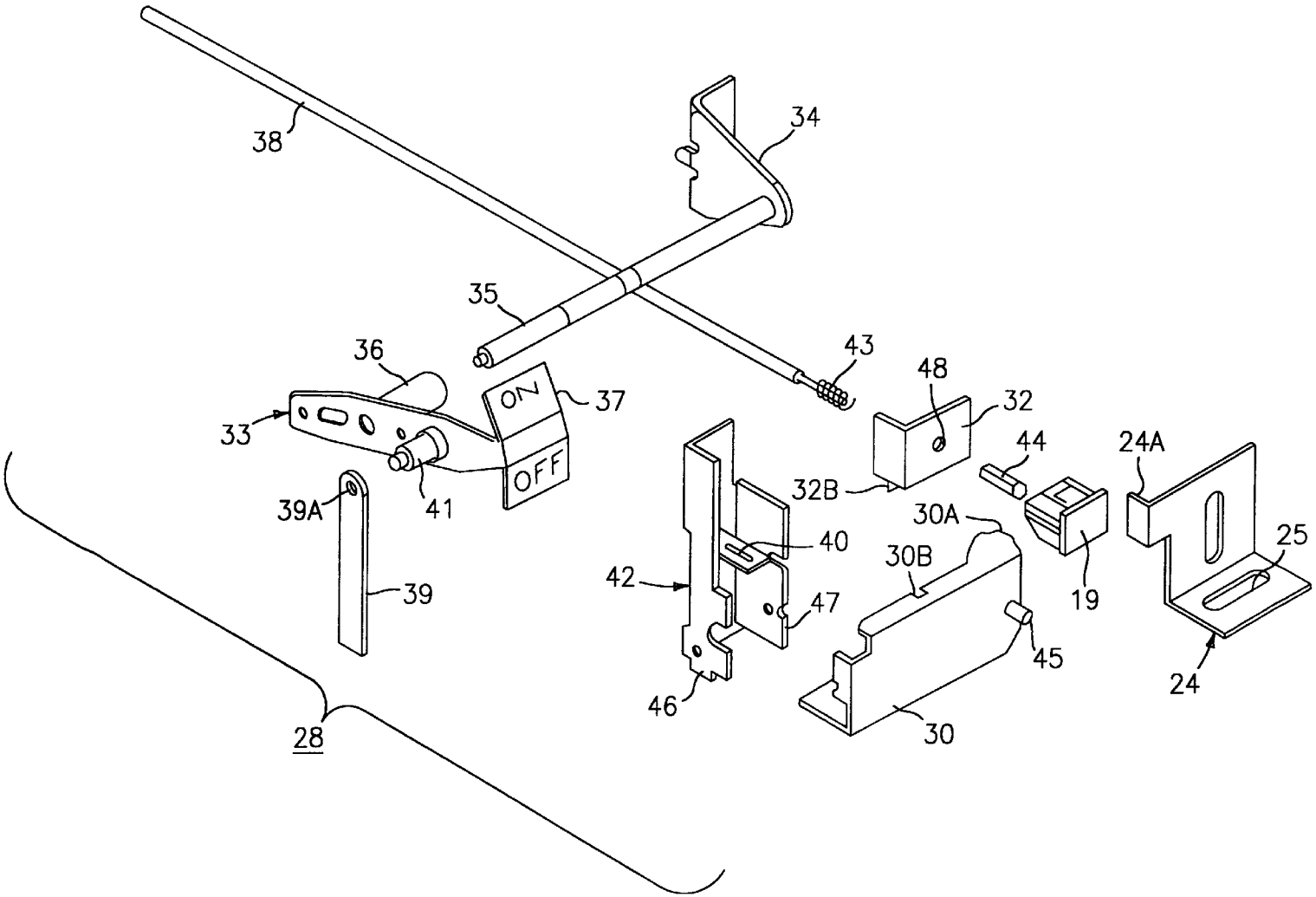
FIG. 2 is a top perspective view of the interlock mechanism of FIG. 1 with the components in isometric projection prior to assembly.

An interlock assembly 28, shown in FIG. 2, includes the lock slide 30 along with the padlock slide 24 and interacts therewith in the manner to be discussed below in some detail. The interlock assembly includes a lock slide 30 having a tab 30A and a slot 30B on the top thereof and a handle grip 45 extending from a front surface. The padlock slide 24 includes a tab 24A that interacts with the tab 30A on the lock slide 30 to prevent the padlock slide 24 from moving into a locking position. The logic plate 32 is positioned on the trip rod 38 and is spring loaded against the access cover 13A of FIG. 1 by means of a torsion spring 43. The trip rod extends through the logic plate opening 48 and is attached to the circuit breaker OFF button 19 via the threaded hex rod 44. A support bracket 34 is also attached to the access cover 13A and retains a pivot rod 35 for supporting the lock lever 33 that includes the target plate 37 at one end and a pivot pin 41 extending from one side thereof. The pivot rod 35 extends through the rod spacer 36 extending from the opposite side of the lock lever 33 and pivotally supports and positions the lock lever within the circuit breaker cover. A locking blade 39 attaches to the end of the pivot pin 41 by means of the aperture 39A and is received in the slot 40 formed within the support plate 42. The support plate defines a pair of opposing sideframes 46, 47 to position and support the locking blade 39.

Figure 3:
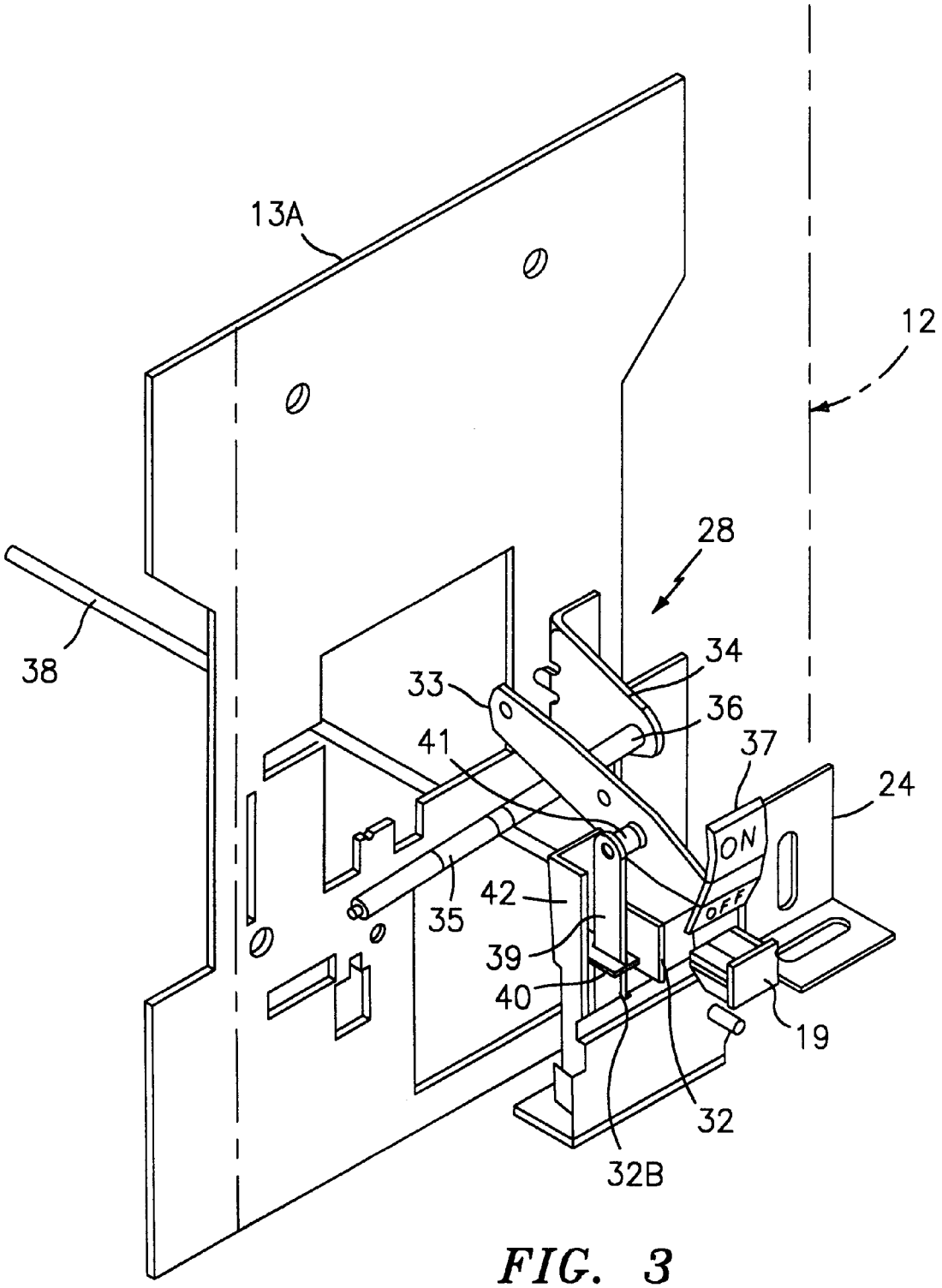
FIG. 3 is a front plan view of the interlock mechanism of FIG. 2 assembled to the cover of the circuit breaker operating mechanism.

The interlock assembly 28 is depicted in FIG. 3 attached to the access cover 13A with the circuit breaker cover 12 indicated in phantom to show the positional relationship between the operating mechanism and the circuit breaker cover. The support bracket 34 is attached to the access cover 13A which positions the lock lever 33, spaced from the support bracket by means of the rod spacer 36, in line with the indicator viewing window 21A shown in FIG. 4. The target plate 37 attached to the end of the lock lever 33 carries the ON and OFF indicia relative to the corresponding conditions of the circuit breaker contacts 16, 17 shown earlier in FIG. 1. The locking blade 39 extends from the pivot pin 41 to within the slot 40 formed within the support plate 42 and the logic plate 32 is positioned between the OFF button 19 and the trip rod 38. The trip rod interacts with the circuit breaker operating mechanism (not shown) to release the operating mechanism springs (not shown) to separate the contacts in the manner described within the aforementioned U.S. patent application Ser. No. 08/863,649. The operation of the logic plate 32 to interfere with the padlock slide 24 to prevent closing the circuit breaker when the contacts are in the OFF condition and the operation of the lock lever 33 to prevent padlocking the padlock slide 24 when the circuit breaker contacts are welded in the ON condition is best seen by referring now to FIG. 4 which depicts the interlock assembly 28 attached to the interior surface of the circuit breaker cover 12 with the access cover 13A shown in phantom to show the positional relationship between the circuit breaker cover 12 and the access cover 13A.

Figure 4:
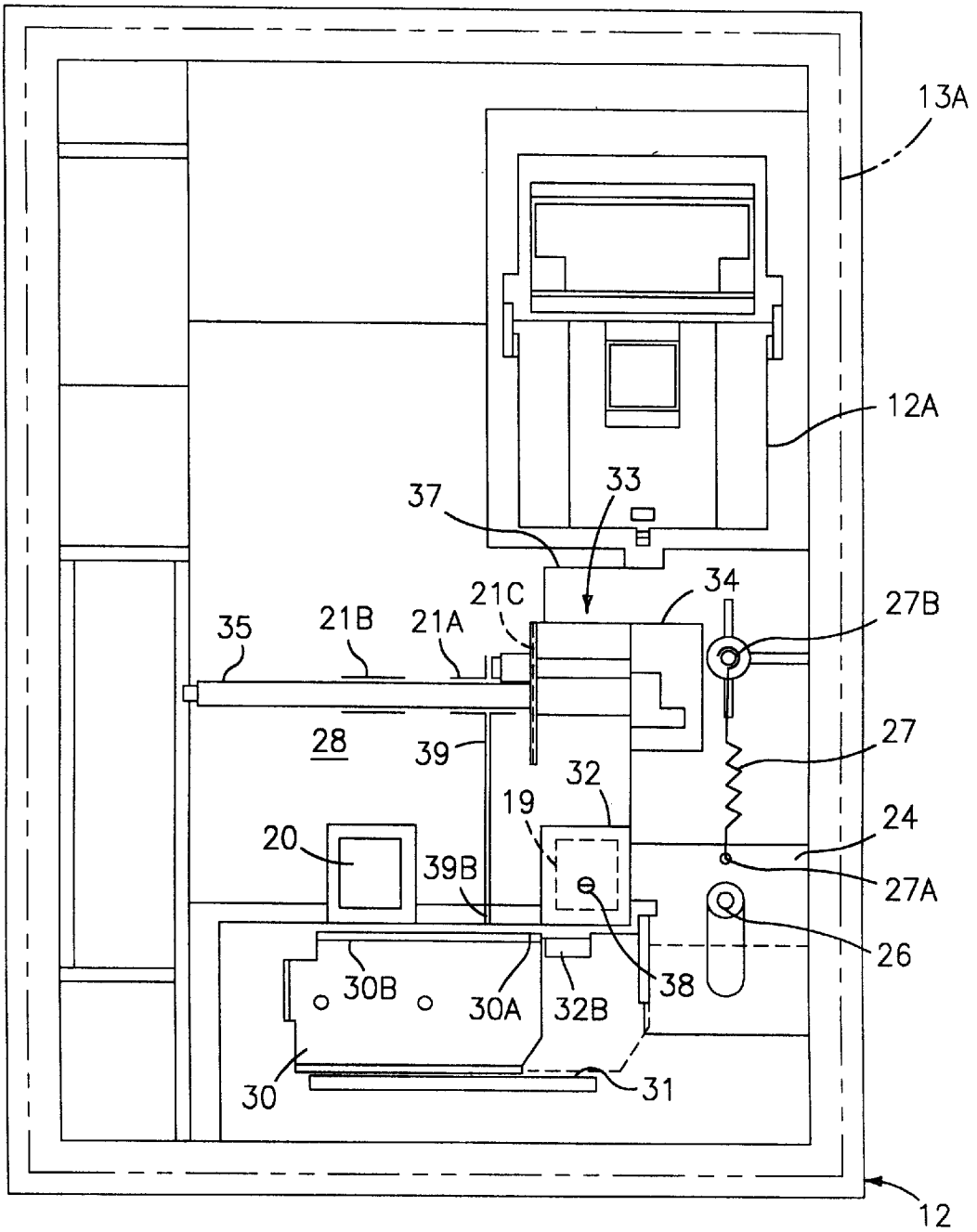
FIG. 4 is an enlarged top view of the modular ratcheting mechanism of FIG. 1 prior to attachment to the circuit breaker operating mechanism enclosure and prior to insertion of the push rod guide-tube assembly.

In FIG. 4, the target plate 37, at one end of the lock lever 33, is arranged beneath the trip unit 12A to present indication of the ON-OFF condition of the circuit breaker contacts through the viewing window 21C. The lock lever is arranged on the pivot rod 35 in line with the viewing windows 21A, 21B, 12C and attached to the access cover 13A by means of the support bracket 34, as described earlier. The other end 39B of the locking blade 39 extending from the lock lever interacts with the slot 30B formed along the top surface of the lock slide 30, by extending through the slot when the lock slide is in the closed condition shown in phantom and the lock lever is unable to rotate from the ON to OFF condition when an attempt is made to open the circuit breaker contacts when they are welded in the ON condition. The lock slide 30 is arranged on the shelf 31 beneath the closing and OFF buttons 20, 19 and the logic plate 32 is arranged on the trip rod 38 which positions the logic plate with respect to the padlock slide 24 to prevent the padlock slide from remaining in the locked position shown in solid lines in abutment with the stop 26 against the return bias of the torsion spring 27, which connects with the locking slide by means of the pin 27A and with the interior surface of the circuit breaker cover 12 by means of pin 27B to the open position indicated in phantom, unless the OFF button is depressed and the target plate 37 has responded. This arrangement insures that the circuit breaker contacts can not be padlocked in the OFF condition unless the contacts have actually separated and are not welded together when the OFF button is depressed. The tab 30A on the top surface of the lock slide 30, as best seen by referring back to FIG. 2, interacts with the tab 32B extending from the bottom of the logic plate 32 out from under the tab 24A on the top of the padlock slide 24. This prevents the padlock slide 24 from moving from the unlocked position shown in phantom in FIG. 4 to the locked condition shown therein in solid lines.

Figure 5:
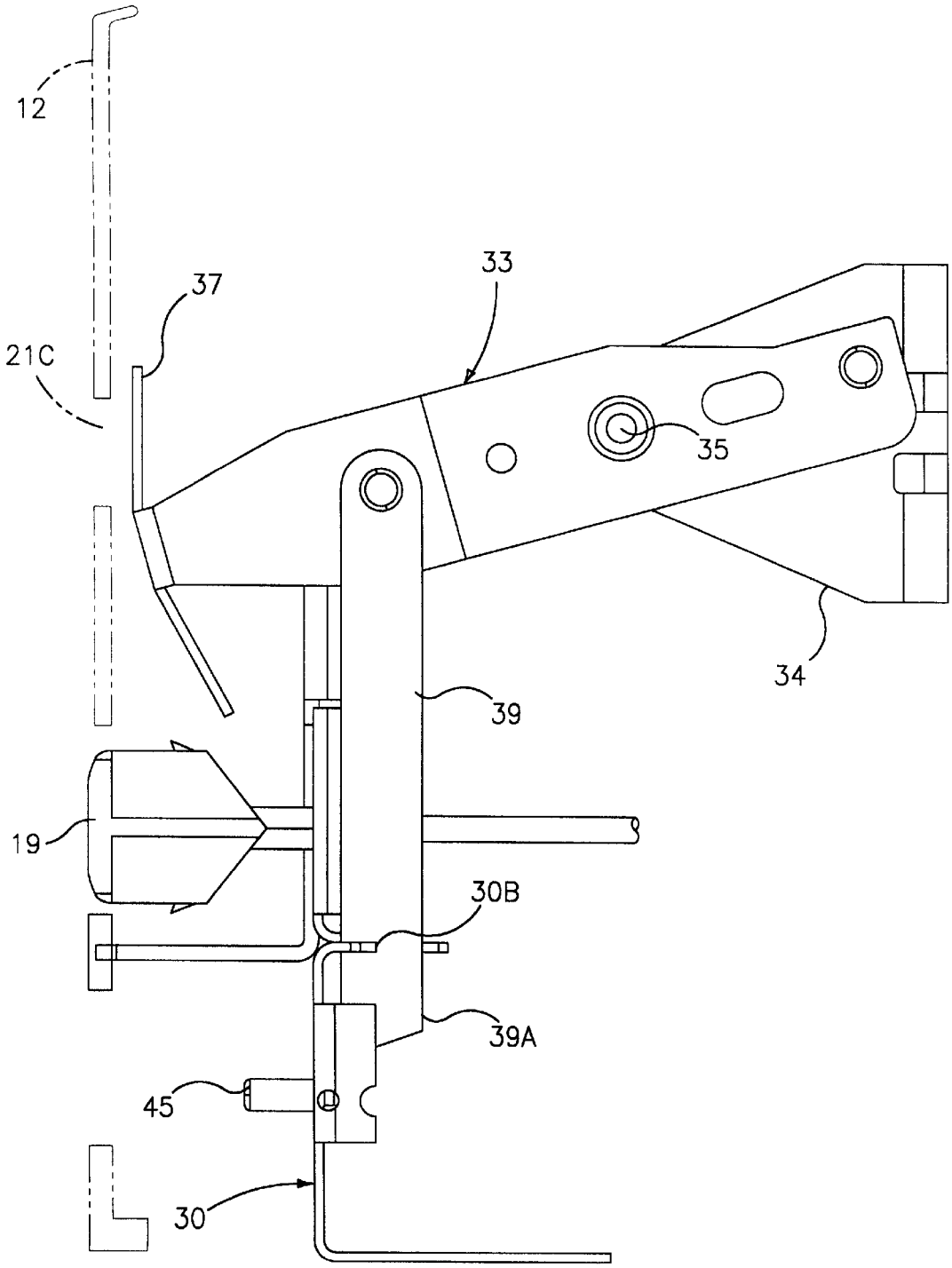
FIG. 5 is an enlarged side view of a part of the ratcheting mechanism of FIG. 4 with the circuit breaker closing springs button in a home position.
Figure 6:
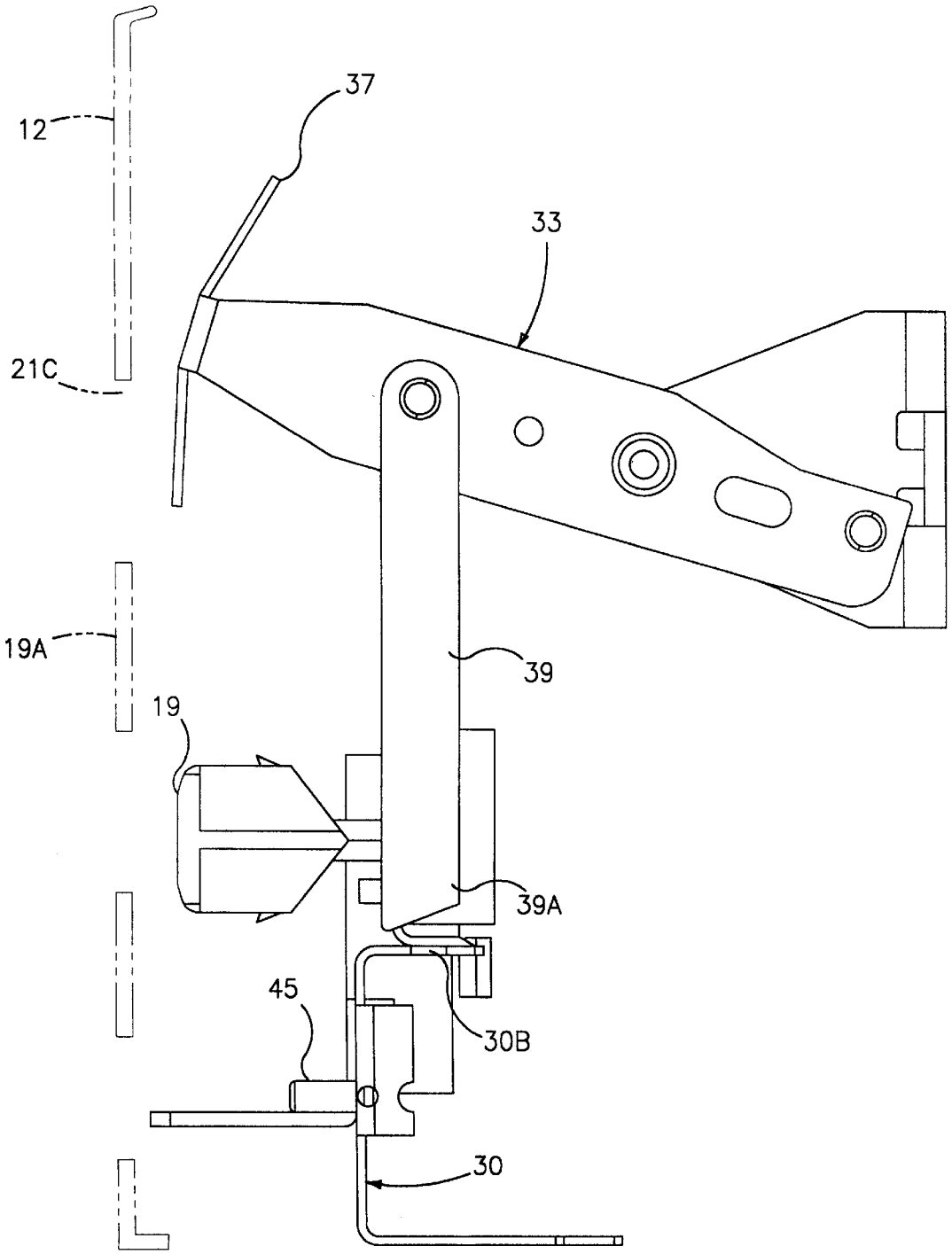
FIG. 6 is an enlarged side view of a part of the ratcheting mechanism of FIG. 4 with the circuit breaker closing springs button in an actuated position.

To move the padlock slide 24 away from logic plate 32, the end 39B of the locking blade 39 must first be removed from the slot 30B on the locking slide, and the locking slide then moved away from the logic plate by moving the handle grip 45 away from the logic plate. The interaction between the locking blade 39 and the locking slide 30 is best seen by now referring to FIGS. 5 and 6. The circuit breaker cover 12 is depicted in phantom therein to show the relationship between the target plate 37 and the viewing window 21C formed in the circuit breaker cover and the access slot 19A through which the OFF button 19 extends. In FIG. 5, the locking blade 39 remains within the slot 30B in the lock slide 30 after the circuit breaker contacts have become welded thereby preventing the lock lever 33 from rotating clockwise about pivot rod 35 on the support bracket 34. When an attempt is made to move the lock lever by accessing the handle grip 45 it is seen that the lock lever 30 prevents movement of the padlock slide 24 to the locked position shown in FIG. 4. When the circuit breaker contacts are in the OFF condition, the lock lever 33 rotates clockwise to the position shown in FIG. 6 taking the end 39A of the locking blade 39 out from the lock slide slot 30B to thereby allow movement of the lock slide 30 and corresponding movement of the locking slide to the locked position.

A circuit breaker push-button interlock arrangement has herein been described whereby logic obtained from the circuit breaker operating mechanism as to the condition of the circuit breaker contacts operates to mechanically prevent operation of the circuit breaker padlock ON-OFF button padlock when the circuit breaker contacts are welded in the ON condition. The interlock also serves to prevent operation of the circuit breaker padlock when the circuit breaker contacts are in the ON condition, per se.

I claim:

1. A circuit breaker push-button interlock arrangement comprising:

a circuit breaker cover;

an ON and an OFF button on said cover for interacting with a circuit breaker operating mechanism to automatically close and open a pair of circuit breaker contacts;

viewing windows on said cover providing indication as to the ON and OFF states of said contacts;

a padlock slide arranged on a front surface of said cover for preventing said ON and OFF buttons from operating to close and open said contacts respectively;

a lock slide arranged on a back surface of said cover for preventing closure of said padlock slide unless said circuit breaker contacts have separated; and a logic plate connecting with said OFF button for preventing closure of said padlock slide unless said circuit breaker contacts have actually separated.

2. The push-button interlock arrangement of claim 1 wherein said logic plate is attached to a circuit breaker operating mechanism trip rod and is arranged to interfere with the movement of said padlock when said circuit breaker contacts have separated.

3. A circuit breaker push-button interlock arrangement comprising:

a circuit breaker cover;

an ON and an OFF button on said cover for interacting with a circuit breaker operating mechanism to automatically close and open a pair of circuit breaker contacts;

viewing windows on said cover providing indication as to the ON and OFF states of said contacts;

a padlock slide arranged on a front surface of said cover for preventing said ON and OFF buttons from operating to close and open said contacts respectively;

a lock slide arranged on a back surface of said cover for preventing closure of said padlock slide unless said circuit breaker contacts have separated; and a target plate arranged on a pivot on said back surface for rotating in and out of alignment with said viewing windows to display ON-OFF status of said circuit breaker contacts.

4. The push-button interlock arrangement of claim 3 further including a locking blade attached to said target plate pivot at one end and extending within a slot on said lock slide at an opposite end when said circuit breaker contacts fail to open.

5. The push-button interlock arrangement of claim 3 wherein said lock slide includes a handle for manually sliding said lock slide when said circuit breaker contacts have separated.

6. A circuit breaker pus-button interlock arrangement comprising:

a circuit breaker cover;

an ON and an OFF button on said cover for interacting with a circuit breaker operating mechanism to automatically close and open a pair of circuit breaker contacts;

viewing windows on said cover providing indication as to the ON and OFF states of said contacts;

a padlock slide arranged on a front surface of said cover for preventing said ON and OFF buttons from operating to close and open said contacts respectively;

a lock slide arranged on a back surface of said cover for preventing closure of said padlock slide unless said circuit breaker contacts have separated; and wherein said padlock slide is attached to said back surface by an extension spring.

7. The push-button interlock arrangement of claim 6 wherein said lock slide includes a slot and wherein said slot abuts against a stop post arranged on said back surface when said lock slide is in a locking position.

8. A circuit breaker comprising:

a support frame;

an operating mechanism within said support frame, said operating mechanism including a contact closing spring;

a moveable contact arm interacting with said contact closing spring for opening and closing a pair of contacts;

a trip unit interacting with said operating mechanism for articulating said operating mechanism to separate said contacts upon command;

a circuit breaker cover arranged over said circuit breaker trip unit;

an ON and an OFF button on said cover for interacting with said circuit breaker operating mechanism to automatically close and open said contacts;

viewing windows on said cover providing indication as to the ON and OFF states of said contacts;

a padlock slide arranged on a front surface of said circuit breaker cover for preventing said ON and OFF buttons from operating to close and open said contacts respectively;

a lock slide arranged on a back surface of said circuit breaker cover for preventing closure of said padlock slide unless said circuit breaker contacts have separated; and a logic plate connecting with said OFF button for preventing closure of said padlock slide unless said circuit breaker contacts have actually separated.

9. The circuit breaker of claim 8 including a target plate arranged on a pivot on said back surface for rotating in and out of alignment with said viewing windows to display ON-OFF status of said circuit breaker contacts.

10. The circuit breaker of claim 9 further including a locking blade attached to said target plate pivot at one end and extending within a slot on said lock slide at an opposite end when said circuit breaker contacts fail to open.

11. The circuit breaker of claim 8 wherein said logic plate is attached to a circuit breaker operating mechanism trip rod and is arranged to interfere with the movement of said padlock slide when said circuit breaker contacts have separated.

12. The circuit breaker of claim 8 wherein said padlock slide is attached to said back surface by an extension spring.

13. The circuit breaker of claim 8 wherein said lock slide includes a slot and wherein said slot abuts against a stop post arranged on said back surface when said lock slide is in a locking position.

14. The circuit breaker of claim 8 wherein said lock slide includes a handle for manually sliding said lock slide when said circuit breaker contacts have separated.

* * * * *